United States Patent [19]

Benteler et al.

[11] 4,267,718

[45] May 19, 1981

[54] APPARATUS FOR PRODUCING A TUBE WITH SUCCESSIVE CORRUGATIONS OF DIFFERENT RADIAL EXTENSIONS AND SPACINGS

[75] Inventors: Hubertus Benteler, Bielefeld; Egon Olszewski; Rainer Hansen, both of Paderborn-Elsen; Ferdinand Wecker, Paderborn-Sennelager, all of Fed. Rep. of Germany

[73] Assignee: Benteler-Werke AG, Paderborn, Fed. Rep. of Germany

[21] Appl. No.: 51,213

[22] Filed: Jun. 22, 1979

[51] Int. Cl.[3] ..... B21D 15/06

[52] U.S. Cl. ..... 72/59; 72/62; 72/385

[58] Field of Search ..... 72/59, 61, 62, 63, 385

[56] References Cited

U.S. PATENT DOCUMENTS

| | | | |
|---|---|---|---|
| 1,980,264 | 11/1934 | Giesler | 72/59 |
| 2,960,142 | 11/1960 | Cimochowski | 72/62 |
| 3,287,949 | 11/1966 | Skinner | 72/62 |
| 3,357,229 | 12/1967 | Luedi | 72/62 |
| 3,704,983 | 12/1972 | Bernard | 72/59 |

*Primary Examiner*—Leon Gilden
*Attorney, Agent, or Firm*—Michael J. Striker

[57] ABSTRACT

Apparatus for producing a tube with successive corrugations of different configuration from a tubular blank of uniform diameter mainly comprises a central pin having a shaft portion fixed only at one end to a stationary support and having at the other end a radially enlarged head portion cooperating with radially inwardly movable clamping and forming jaws to clamp a portion of a tubular blank therebetween. The apparatus includes further a tubular member guided on the shaft portion of the central pin and movable in axial direction by hydraulically operated members cooperating therewith. The tubular member supports the blank on the inner surface of the latter and cooperates with a plurality of clamping fingers arranged axially spaced from the head portion about the outer periphery of the blank and being movable by a hydraulically operated clamping piston between a clamping and a releasing position, whereby between the head portion, one end of the tubular member and the clamped portion of the blank an annular expansion space is formed into which fluid under pressure is fed, to cause outward bulging of the blank between the clamped portion thereof. The above-mentioned hydraulically operated members comprise an upsetting cylinder connected at one end to the other end of the tubular member and including a radially enlarged portion in which the clamping piston is housed, and a corrugation cylinder cooperating with the upsetting cylinder for moving the latter between a rest position and an advanced position. In order to adjust the upsetting stroke and therewith the radial extension of the corrugations to be formed, a pair of annular discs are turnably, but axially immovably mounted on opposite ends of the corrugation cylinder and having a plurality of circumferentially displaced axial projections of different axial lengths which can be respectively brought into alignment with abutment members provided on the enlarged portion of the upsetting cylinder and the support.

8 Claims, 4 Drawing Figures

APPARATUS FOR PRODUCING A TUBE WITH SUCCESSIVE CORRUGATIONS OF DIFFERENT RADIAL EXTENSIONS AND SPACINGS

BACKGROUND OF THE INVENTION

The present invention relates to an apparatus for producing a tube with successive corrugations of different configuration and especially of different radial extension from a tubular blank of constant diameter.

The DE-AS No. 13 03 671 discloses an apparatus for continuous production of annular corrugations of substantially equal configuration from a tubular blank of constant diameter. This apparatus comprises a stationarily mounted vertically arranged core pin which is provided with an axially extending hollow section for guiding a multiple part tube mandrel as well as a piston-like enlargement at the free end of the shaft section, which forms an abutment for radially movable, hydraulically operated holding and forming jaws. After pushing a smooth-walled tubular blank onto the core pin, the holding and forming jaws are first moved in engagement with the blank to press the latter against the piston-like enlargement. Subsequently thereto, clamping jaws are pressed by means of radially arranged hydraulically operated cylinder-and-piston units connected with the mandrel against the blank, whereby the mandrel supports the blank inwardly at the region of the clamping jaws. Between the piston-like enlargement, the tubular mandrel and the tubular blank there is now formed an annular expansion space which is impinged by pressure fluid fed into the space through the hollow shaft and a crossbore, so that the wall of the tubular blank bulges outwardly. After the bulge reaches a predetermined dimension, the tubular mandrel together with the clamping jaws and the clamped blank is moved by means of hydraulically operated cylinder-and-piston units arranged parallel to the core pin in direction toward the piston-like enlargement, whereby the tubular wall is expanded and an annular corrugation is formed.

A disadvantage of this known apparatus is the necessary sealing of the expansion space in the region of the piston-like enlargement and that of the tubular mandrel. Sealing rings of elastic material are provided for this purpose, which are axially compressed to thus be radially deformed and pressed against the inner surface of the tubular blank, respectively against the previously produced corrugation. The compression of the seal in the region of the piston-like enlargement and that of the tubular mandrel is produced by cylinder-and-piston systems which are axially displaced by hydraulic fluid. The elastic seals are, during forming of corrugations in the blank, continuously compressed and again released, so that the material will necessarily fatigue, respectively be worn, which will result in leakage, and in addition the cylinder-and-piston units for the compression of the elastic seals have to be properly sealed.

The therewith-connected necessary exact fits and seals considerably increase the manufacturing cost. In addition, increased maintenance cost is necessary in order to assure a proper function of this apparatus. Especially disadvantageous in this known construction is the necessary feeding of the hydraulic fluid to the cylinder-and-piston unit in the multipart tube mandrel. For this purpose, there is provided in the hollow shaft an additional tube. It is also of disadvantage that the cylinder-and-piston unit in the piston-like enlargement is to be supplied with hydraulic pressure fluid. For this purpose an additional conduit is provided at the outer end of the piston-like enlargement. This necessary additional tube will complicate the removal of a finished corrugated tube, as well as the placement of a new tubular blank into the apparatus. An automatic feeding of the blanks is, therefore, impossible. In addition, the known apparatus needs, due to its construction, a large installation space.

Another apparatus for continuous production of successive corrugations of substantially uniform configuration is disclosed in the application Ser. No. 40,275, filed May 18, 1979, now U.S. Pat. No. 4,237,713.

The object of this last-mentioned apparatus is to provide an apparatus of the aforementioned kind which is compacter than such apparatus known in the art, which will operate substantially trouble-free, and which facilitates automatic feeding of the tubular blanks into the apparatus and removal of the finished corrugated tube therefrom. This known apparatus mainly comprises support means, a central pin having an elongated shaft portion fixedly attached only at one end to the support means and having a radially enlarged head portion at the other end, a tubular member mounted on the shaft portion of the central pin for movement in axial direction and adapted to support together with the head portion in a tubular blank at the inner surface therefrom, in which the tubular member has one end axially spaced from the head portion to form between this one end and the head portion and a blank supported thereon an expansion chamber. The apparatus includes further first clamping means comprising a plurality of hydraulically operated radially movable holding and forming jaws opposite the head portion, second clamping means comprising a plurality of circumferentially displaced radially tiltable clamping fingers of a collet arranged in the region of the one end of the tubular member about the outer circumference of the blank supported by the latter, a hydraulically operated axially movable annular clamping piston surrounding the clamping fingers for moving the latter between a clamping and a releasing position, an upsetting cylinder connected at one end to the other end of the tubular member and having opposite this one end a radially enlarged end portion surrounding and guiding the clamping piston for movement in axial direction. This known apparatus further includes an axially movable corrugation cylinder surrounding part of the upsetting cylinder and being formed with an annular groove, an annular collar fixed to the upsetting cylinder and located in the aforementioned annular groove of the corrugation cylinder and forming in this groove two chambers adapted to be alternatingly filled with pressure fluid so as to axially move the upsetting cylinder relative to the corrugation cylinder, and means for feeding pressure fluid into the aforementioned expansion chamber after axially spaced portions of the blank have been clamped against the head portion and said one end of the tubular member by the first and second clamping means to thus expand a portion of the blank clamped between the first and the second clamping means into a corrugation.

This will provide a construction which, compared with the construction of the other above-discussed prior-art apparatus, has only a small radial extension beyond the outer circumference of the tubular blank. Thus the apparatus can be installed in a relatively small space. Furthermore, the means for clamping the tubular blank and to advance the latter to form the corrugations are arranged closely about the tubular blank. No cylinder-and-piston units, which require closely fitted parts and seals liable to wear are provided in the interior of the tubular blank. The tubular member mounted on the shaft portion of the pin is an integral part guided along its total length on the shaft portion.

An additional advantage of the construction of the last-mentioned apparatus is that the central pin is mounted only at one end thereof on the support means, whereas on the other end no tube for feeding hydraulic fluid is necessary. This provides free access to the apparatus so that an automatic feeding of the tubular blanks into the apparatus and removal of the finished corrugated tube are possible. The gripping of the tubular blank occurs by means of axially directed clamping fingers, which by means of a clamping piston, movable relative to the clamping fingers, are pressed against the tubular blank, so that the latter in turn is pressed against the members extending therethrough. Due to the projection of the annular collars into the corresponding annular grooves, circumferentially extending pressure chambers are formed so that by feeding pressure fluid into the latter, a predetermined displacement of the various parts in the desired direction is accomplished. The expansion space between the head portion of the central pin and the tube mandrel is sealed by simple metallic seals on the clamping and forming jaws and the clamping fingers. Additional extensive sealing systems as are necessary in the known apparatus, are avoided.

A corrugation is formed by axially displacing the upsetting cylinder relative to the corrugation cylinder, while the tubular blank is clamped and the relative movement of the two cylinders establishes the axial dimension of the corrugation.

The central pin is relatively simple in its construction since it has only a longitudinal bore and a crossbore through which the pressure fluid is fed into the expansion space.

According to an advantageous feature of the last-mentioned apparatus, the corrugation cylinder is provided with a second annular groove, axially spaced from the first-mentioned annular groove, and the arrangement includes a sleeve fixedly connected to the support means and having an inner surface guiding the upsetting cylinder and an outer surface guiding the corrugation cylinder. The sleeve has an annular collar projecting into the second annular groove of the corrugation cylinder and dividing the annular groove into two compartments adapted to be alternatingly filled with pressure fluid so as to axially move the corrugation cylinder in one and the opposite direction relative to the sleeve.

According to a further feature of the last-mentioned apparatus, a pair of adjusting nuts are axially adjustable connected to opposite ends of the corrugation cylinder, whereby the adjusting nut in the region of the radially enlarged end portion of the corrugation cylinder serves to adjust the compression stroke, whereas the other adjusting nut serves to steplessly adjust the distance between successive corrugations.

Even though the aforedescribed construction permits to change the compression stroke, as well as the distance of successive corrugations to change in dependence of the respective desired dimensions of the corrugations, the sequence of operations will be fixed for any adjustment carried out on the apparatus. The radial dimensions of the corrugations and the distance between successive corrugations will thus remain the same over the total length of the corrugated tube. In this known construction an inadmissable high manual expenditure would be necessary to produce a corrugated tube which over its length has stepless, or in successive steps, different radial dimensions, respectively different axial distances between successive corrugations.

SUMMARY OF THE INVENTION

It is, therefore, the main object of the present invention to improve the last above-described apparatus further so that corrugated tubes may be produced in which successive corrugations have different radial dimensions and/or different distances from each other.

In order to obtain this desired result, the present invention provides at opposite ends of the corrugation cylinder of the known last-mentioned construction a pair of annular discs turnable about the axis of the latter, but axially immovable thereto and each provided with axially extending projections cooperating with a pair of abutments respectively provided on the radially enlarged end portion of the upsetting cylinder and on the support means and respectively located opposite the projections.

By a preprogrammed regulated turning of the two annular discs respectively provided at opposite ends of the corrugation cylinder about the longitudinal axis of the latter it is thus possible, after forming one corrugation, to bring in the rear end position of the corrugation cylinder and the upsetting cylinder predetermined axial projections on the annular discs in axial alignment with the abutments respectively provided at the radially enlarged end portion of the upsetting cylinder and on the support means, which will thus provide radially larger or smaller corrugations and/or a different spacing of two axially successive corrugations during the next working stroke. This change may be produced after each corrugation or after a preselected number of equal corrugations has been formed.

In this way it is possible to produce corrugated tubes which have for instance a conical or substantially hourglass shaped outline. Thereby, the outline may change continuously from one to the next corrugaton or stepwise over a plurality of corrugations. It is also possible to produce corrugated tubes, the outer contour or outline of which varies in any desired manner from a cylindrical contour. The construction of the present invention permits, therefore, to produce especially such corrugated tubes which form part of a deformation member of safety steering columns for automotive vehicles in which an exactly determined characteristic of the deformation is desired. The regulation of the turning of the annular disc may be preprogrammed in dependency on the desired contour of the corrugated tube to be produced.

The length of the axial projections may steplessly or in steps increase, respectively decline, over the circumference of the annular discs. In a preferred arrangement, especially suitable for practical requirements, the axial projections have different lengths and are uniformly spaced in circumferential direction of the annular discs.

In a preferred construction the plurality of axial projections are arranged on each disc in two groups each extending through 180° in circumferential direction, with the axial lengths of the projection in each group changing from one to the next and with a projection of a given length in one group located diametrically opposite a projection of the same length in the other group. This will assure that during striking of the projections against the corresponding abutments the various elements are equally loaded and jamming of the discs is avoided.

According to the present invention the regulated turning of the annular discs is actuated by providing a ring gear on the outer circumference of each annular disc and respectively meshing with a pair of pinions which are driven by gear motors. By corresponding control of the gear motors, which may for instance be preprogrammed, it is then possible to bring any desired axial projection of the two annular discs in a desired position in which the respective axial projections are axially aligned with the abutments provided at the enlarged portion of the upsetting cylinder, respectively on the support means. In this way it is, therefore, possible to change in any desired sequence the radial extensions of successive corrugations and/or the distance between the same.

In a preferred construction according to the present invention a plurality of switching cams coordinated with at least some of the axial projections are provided on the annular discs and these switching cams cooperate with stationary limit switches in circuit with the motors and arranged for being tripped by the cams. In this way it is possible to preprogram directly on the annular discs a desired sequence of corrugation shapes. The arrangement is made in such a manner that in the retracted rest position of the corrugation cylinder and the upsetting cylinder an impulse is imparted to the gear motors starting rotation of the same and corresponding rotation of the annular discs. After the discs have been turned through a respective angle the switching cams provided thereon will engage the limit switches which thus will interrupt the current supply to the gear motor and stop the latter.

To make a free choice of the corrugation program possible, the invention provides for a change of the circumferential position of the switching cams on the annular discs. In dependency on the number of the provided axial projections, the number of switching cams may be chosen in any desired manner. If, however, only two, respectivelythree, different corrugations for each corrugated tube should be provided, then of course only two or three switching cams are necessary, which are coordinated with the corresponding axial projections on the circumference of the annular discs. The same of course holds true for the annular disc by means of which the distance between successive corrugations is controlled.

In a preferred construction, which is especially suitable for the practical requirements of the apparatus according to the present invention, the switching cams are mounted on ring segments which are exchangeably connected to those sides of the annular discs which are opposite to the sides thereof on which the projections are provided. In this case the predetermined program may be connected to the annular discs by means of such ring segments on which the switching cams are provided at the desired locations. The ring segments with the switching cams thereon may be connected to the annular discs, for instance by dowel pins, or other quickly establishable connections.

The start of the gear motors in the retracted end position of the corrugation cylinder and the upsetting cylinder is produced according to the present invention in that an abutment is provided on the corrugation cylinder which in the rest position thereof engages a limit switch in circuit with the gear motors, so that during contact of the limit switch by the abutment the gear motors are started and turn the corresponding annular disc through such an angle until the switching cam thereon engages the corelated limit switch to thereby stop the gear motor. Thereafter forming of a new corrugation corresponding to the preselected program may again begin.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
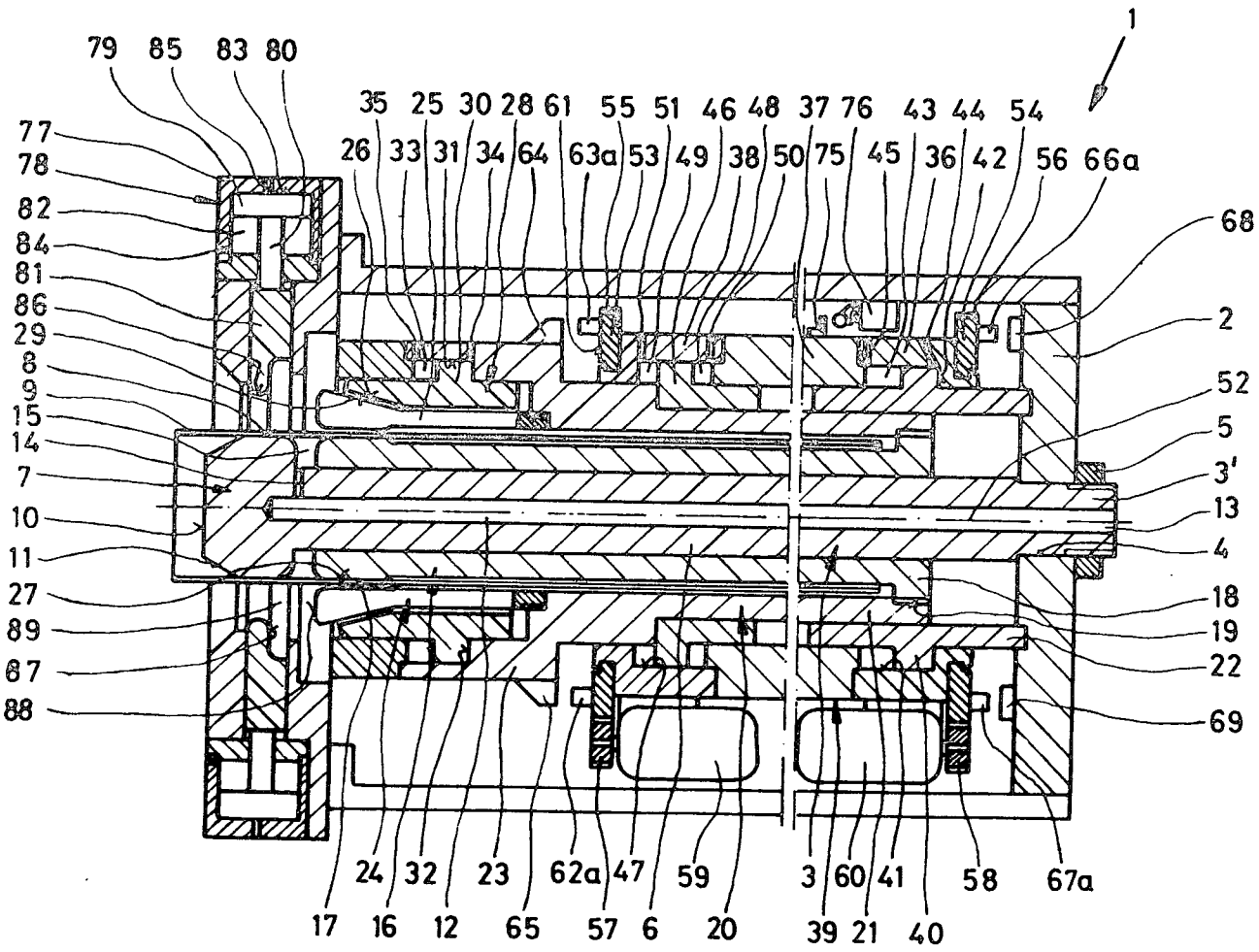
FIG. 1 is a vertical axial cross-section through the apparatus of the present invention.
Figure 2:
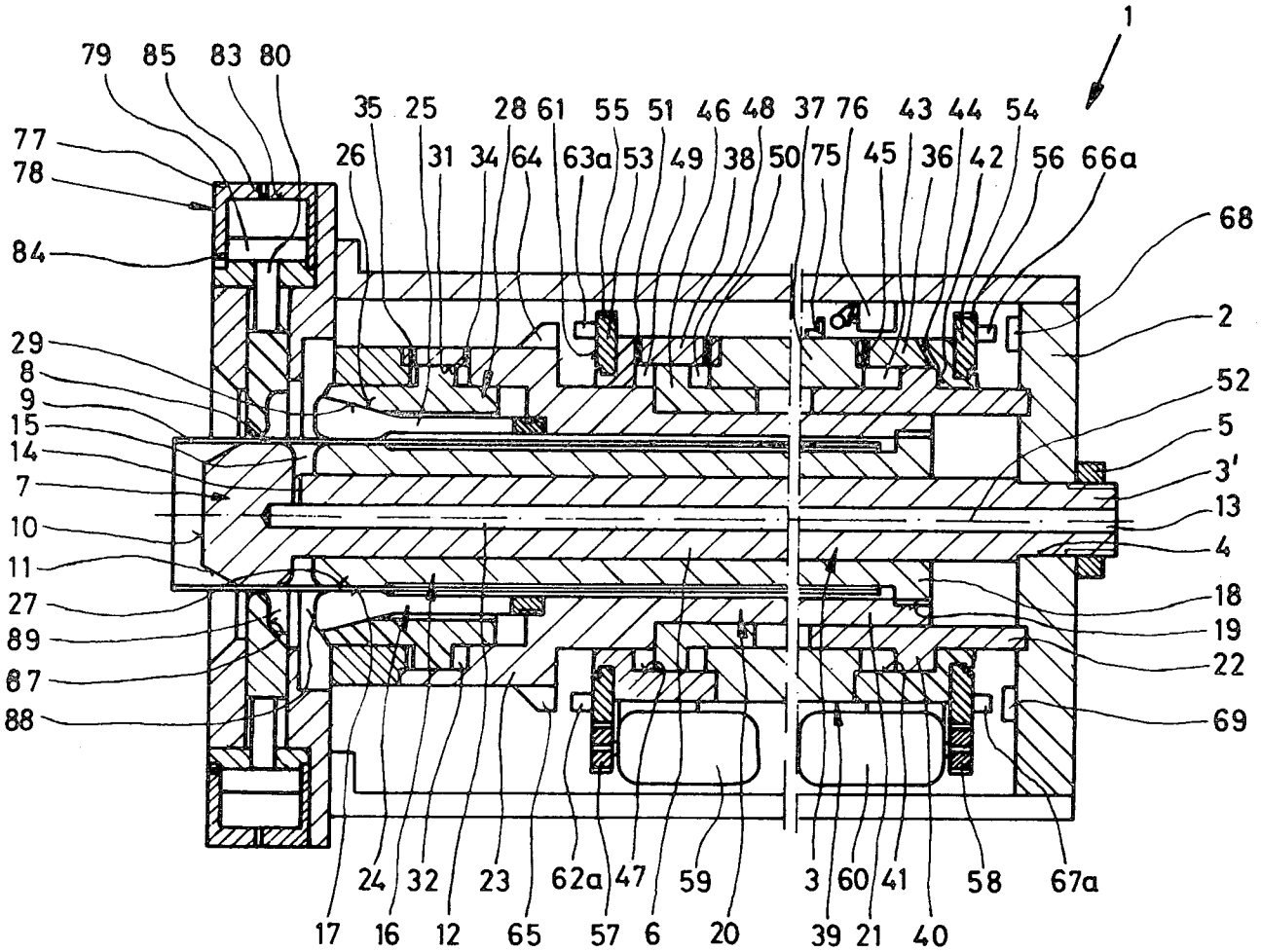
FIG. 2 is a cross-section similar to that of FIG. 1, but showing some of the elements of the apparatus in a different position.

The apparatus illustrated in vertical cross-section in FIGS. 1 and 2 serves to produce a corrugated tube, which may, for instance, be used as part of a steering column of an automobile.

The apparatus comprises a cylindrical housing 1, which is closed at one end by a cover 2. The cover 2 serves to mount a central pin 3 extending in axial direction throughthe housing. The central pin 3 has at its right end, as viewed in the drawing, a reduced diameter portion 3', which extends with a close fit through a corresponding bore 4 in the cover 2, and a nut 5 screwed onto the outer threaded end of the reduced diameter portion presses the shoulder formed at the inner end of the reduced diameter portion of the pin 3 against the cover 2, to thus fix the axial position of the central pin.

The central pin 3 has a relatively long cylindrical shaft portion 6 and a piston-shaped head portion 7. The head portion 7 has a cylindrical part 8, the diameter of which corresponds to the inner diameter of a smooth-walled tubular blank 9 which has to be corrugated in the apparatus. The head portion 7 has an end face 10 and a frustoconical section 11 is located between the cylindrical portion of the head portion 7 and the end face.

A central bore 12 extends through the shaft portion 6 and part of the head portion 7 and the outer end 13 of the bore 12 is connected to a source of hydraulic pressure fluid, not shown in the drawing. At the transition of the shaft portion 6 to the head portion 7 there are provided a plurality of crossbores 14 (only one of which is shown) through which the axial bore 12 communicates with an expansion space 15 to be described later on.

The shaft portion 6 serves to mount and guide substantially without play a tube mandrel or tubular member 16, which is provided adjacent to the head portion 7 with a cylindrical section 17 having a larger diameter than the remainder of the tubular member and corresponding to the inner diameter of the tubular blank 9. The other end of the tubular member 16 is provided with an annular collar 18 formed with an outer screw thread 19 which serves to fixedly connect to the tubular member 16 a compression or upsetting cylinder 20, arranged coaxial with the tubular member 16, but surrounding the tubular blank 9 with play.

The upsetting cylinder 20 is guided with its right end portion 21, as viewed in the drawing, in a sleeve 22 fixed to and inwardly projecting from the cover 2, whereas the other end portion of the upsetting cylinder 20 is provided with an annular enlargement 23, which encompasses a collet 24 threadingly connected at one end to the upsetting cylinder 20. The collet 24 comprises axially extending clamping fingers 25 which are limited tiltable in radial direction and which are distributed uniformly around the circumference of the tubular blank 9.

The clamping fingers 25 are provided with frustoconical outer surfaces 26 tapering toward the connected end of the clamping fingers, whereas the inner surfaces 27 of the clamping fingers are in this region cylindrically formed and the axial length of the surfaces 27 corresponds substantially to the blank supporting, opposite surface 17 of the tubular member 16.

The clamping collet 24 is surrounded by an annular clamping piston 28 which is axially guided in the enlarged portion 23 of the upsetting cylinder 20. The clamping piston 28 has in the region of the outer surfaces of the clamping fingers 25 a conically tapering inner surface 29. The clamping piston 28 is further provided at its outer surface and intermediate its ends with an annular collar 30 which sealingly engages in an annular groove 31 provided in the enlarged portion 23 of the upsetting cylinder 20. The annular collar 30 divides the annular groove 31 in two annular spaces 32 and 33 to opposite sides of the annular collar 30 and these spaces are connected through bores 34 and 35 respectively to a hydraulic circuit, not illustrated in the drawing, for alternatingly feeding pressure fluid into and discharging pressure fluid from these spaces.

The outer surface of the sleeve 22 connected to and projecting inwardly from the cover 2 serves also to guide a corrugation cylinder 39 composed of three coaxially interconnected sections 36, 37 and 38. The sleeve 22 is provided, substantially midway between the ends thereof, with an annular collar 40 which sealingly engages into a corresponding annular groove 41 provided in the corrugation cylinder 39. The spaces 42 and 43 thus formed to opposite sides of the annular collar 40 are connectable over connecting bores 44, respectively 45, with a hydraulic circuit, not illustrated in the drawing, so that these spaces may be alternately supplied with pressure fluid or pressure fluid discharged therefrom.

As shown in FIGS. 1 and 2, the upsetting cylinder 20 is also provided with an annular collar 46, fixedly connected thereto in any conventional manner, which sealingly engages in an additional annular groove 47 provided in the corrugating cylinder 39. The spaces 48 and 49 thus formed to opposite sides of the annular collar 46 are also connected over bores 50, respectively 51, to a non-illustrated hydraulic circuit for feeding pressure fluid into respectively discharging pressure fluid from these spaces.

Figure 3:
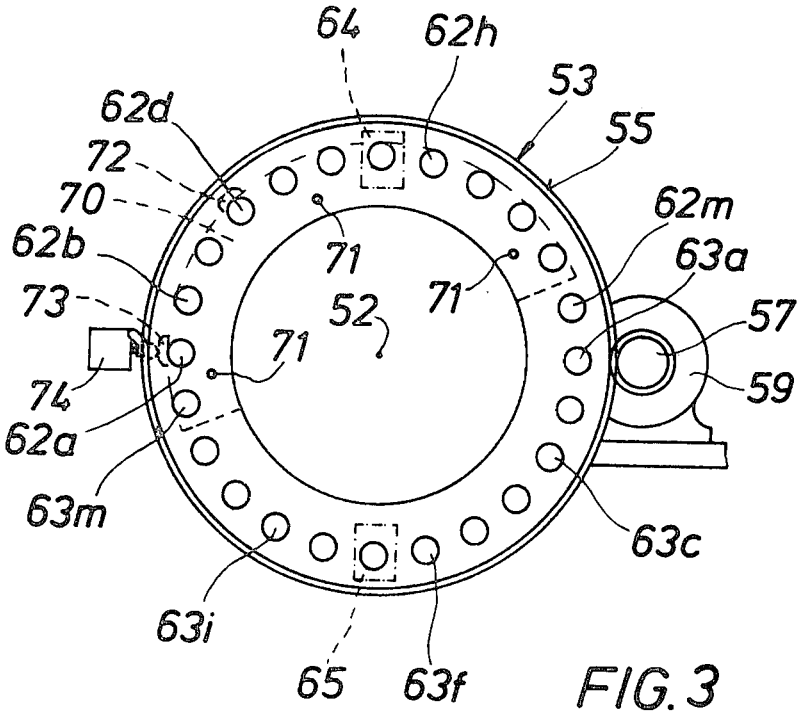
FIG. 3 is an end view at an enlarged scale of one of the annular discs.
Figure 4:
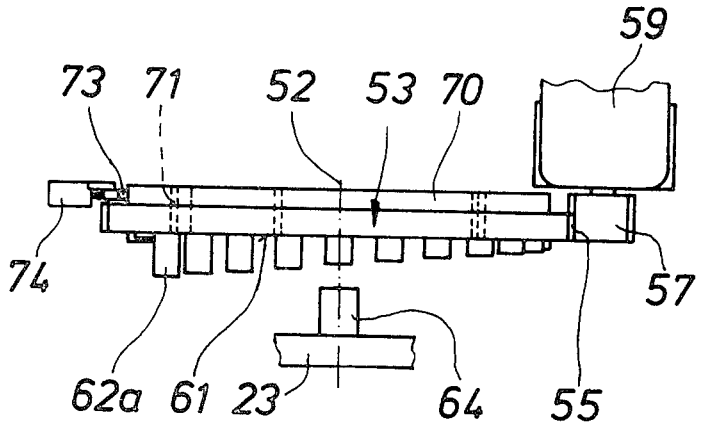
FIG. 4 is a top view of the disc shown in FIG. 3.

A pair of annular discs 53 and 54 are turnably, but axially immovably respectively mounted on opposite ends of the corrugation cylinder 39 (see also FIGS. 3 and 4). The annular discs 53 and 54 are provided at the outer circumference thereof with ring gears 55 and 56 respectively fixedly connected thereto, and meshing respectively with pinions 57 and 58 which are respectively fixedly mounted on the output shafts of two gear motors 59 and 60 which in turn are mounted on the corrugation cylinder 39.

The annular disc 53 is provided on its end face 61 thereof facing the enlarged portion 23 of the upsetting cylinder 20 with two groups of axial projections or abutment cogs *62a–62m*, respectively *63a–63m*. The axial length of the projections changes in a uniform manner in each group from one to the next projection. Projections of equal length in the two groups, for instance *62a* and *63a* or *62g* and *63g* are arranged diametrically opposite each other with respect to the axis 52 of the annular discs.

Two fixed abutments 64 and 65 are provided on the enlarged portion 23 of the upsetting cylinder displaced through 180° with respect to each other with which the projections *62a–62m*, respectively *63a–63m* may be axially aligned.

Corresponding to the annular disc 53 the annular disc 54 is also provided with two groups of axial projections or abutment cogs *66a–66m* and *67a–67m*. The cover 2 on which the central pin 3 is mounted is also provided with two, through 180° displaced abutments 68 and 69.

As further shown in FIGS. 3 and 4 an annular segment 70 is releasably mounted on the rear side of the annular disc 53 and it is to be understood that a corresponding segment is also attached to the rear side of the disc 54. The releasable connection between the respective annular disc and the disc segment can be, for instance, carried out by dowel pins 71 extending through aligned bores in the annular disc and the disc segment, or by any other appropriate connection. The annular segment 70 carries in a predetermined arrangement, for instance as shown in FIG. 3, two switching cams 72 and 73 located adjacent to the axial projections *62d* and *62a*. The switching cams 72 and 73 are arranged to cooperate with a stationarily mounted limit switch 74 which is in circuit with the gear motor 59. It is to be understood that a corresponding switching arrangement is provided between the disc 54 and the gear motor 60.

As further shown in FIG. 1 an abutment 75 is fixedly mounted on the outer periphery of the corrugation cylinder 39 and adapted to cooperate with a limit switch 76 mounted in stationary position on the inner surface of the cylindrical housing part and connected in circuit with the gear motors 59 and 60.

The cylinders 77 of four, circumferentially through 90° displaced cylinder-and-piston units 78 are connected to the end of the cylindrical housing 1 which is opposite the end in which the cover 2 is mounted. Each cylinder-and-piston unit 78 comprises further a piston 79 guided for reciprocation in the respective cylinder 77 and a piston rod 80 fixedly connecting each piston with a clamping and forming jaw 81. The cylinder spaces 82 and 83 to opposite sides of the piston 79 are provided with connecting bores 84, respectively 85, adapted to be connected to a hydraulic circuit, not illustrated in the drawing, to feed, respectively discharge, pressure fluid into and from the cylinder spaces.

The clamping and forming jaws 81 are guided for radial movement and each of the same is provided with a nose-like projection 86 as well as with a cutout 87 facing the clamping jaws 25. The cutouts 87 form together with the end faces 88 of the clamping fingers 25 a corrugation space 89 in which a corrugation is to be formed.

The above-described apparatus will be operated as follows:

As shown in FIG. 1 the pistons 79 are by feeding pressure fluid through the bore 84 into the cylinder spaces 82, in their radially outer positions so that the clamping and forming jaws 81 are radially spaced from the head portion 7. The pressure space 33 in the enlarged portion 23 of the upsetting cylinder 20 is likewise filled with pressure fluid so that the clamping piston 28 is moved to its right end position and the clamping fingers 25 may, therefore, radially expand. In addition the pressure space 43 in the corrugation cylinder 39 is likewise filled through the bore 45 with pressure fluid, so that the corrugation cylinder 39 is in its left end position, whereas the pressure space 49 in the corrugation cylinder 39 is filled with pressure through the bore 51, so that the upsetting cylinder 20 is in its right end position.

In these positions of the various elements of the apparatus it is possible to insert a tubular blank 9 of pre-cut length over the head portion 7 in proper position into the apparatus.

In order to fix the tubular blank 9 in the desired position, the cylinder spaces 83 of the cylinder-and-piston units 78 are filled through the bores 85 with pressure fluid, so that the pistons 79 move radially inwardly to the position as shown in FIG. 2, whereby the holding and forming jaws 81 press the tubular blank 9 against the head portion 7. At the same time, or shortly thereafter, the pressure space 32 in the enlarged portion 23 of the upsetting cylinder is filled with pressure fluid through the bore 34, so that the clamping piston 28 is moved in direction toward the holding and forming jaws 81, and so that the conical inner surface 29 of the clamping piston 28 presses the clamping fingers 25 against the outer circumference of the tubular blank 9, which is therewith clamped between the tubular member 16 and the collet 24. An expansion space 15 is thus formed between the head portion 7, the tubular member 16 and the tubular blank 8 and this expansion space can be supplied with pressure fluid over the crossbores 14 and the longitudinal bore 12 in the shaft portion 6 of the central pin 3.

By feeding pressure fluid through the longitudinal bore 12 and the crossbores 14 into the expansion space 15, the wall of the tubular blank 9 will bulge radially outwardly between the two clamping regions formed, on the one hand, by clamping and forming jaws 81 and the head portion 7 and, on the other hand, by the clamping fingers 25 and the tubular member 16. The magnitude of the pressure in the expansion space 15 is chosen in such a manner that during the outward bulging of the tubular blank 9 no essential decrease of the wall thickness thereof is produced.

Subsequently thereto the pressure space 48 in the corrugation cylinder 39 is filled with pressure fluid through the bore 50, while the inner pressure in the expansion space 15 is maintained, so that the tubular blank 9 clamped between the clamping fingers 25 and the tubular member 16 is moved in the direction toward the head portion 7 to thereby produce a first corrugation in the currugation space 89. The clamping and forming jaws 81 continue to press thereby the end section of the tubular blank 9 against the head portion 7. After the first corrugation is thus produced, pressure fluid is first discharged from the expansion space 15 and subsequently thereto the clamping piston 28 is moved to its right-end position by feeding pressure fluid into the pressure space 33 in the enlarged portion 23 of the upsetting cylinder 22, so that the clamping fingers will disengage the tubular blank 9.

The tubular blank rests now freely on the tubular member 16. The holding and forming jaws 81 press however the tubular blank 9 still against the head portion 7.

If subsequently thereto the pressure spaces 42 and 49 in the corrugation cylinder 38 are filled with pressure fluid, then the corrugation cylinder 39 as well as the upsetting cylinder 20 with its enlargement 23 together with the clamping fingers 25 and the tubular member 16 are moved back toward the right, as viewed in the drawing, through a distance which is equal to the upsetting stroke plus the axial spacing of two successive corrugations. The holding and forming jaws 81 remain also during this movement of the other elements pressed against the head portion 7.

Subsequently thereto, the pressure space 32 in the enlarged portion 23 of the upsetting cylinder 20 is again filled with pressure fluid so that the clamping fingers 25 are pressed against the outer periphery of the tubular blank 9 and the latter pressed against the tubular member 16. Thereafter, the cylinder spaces 82 in the cylinder-and-piston unit 78 are filled with pressure fluid so that the holding and clamping jaws 81 are disengaged from the tubular blank 9.

By subsequently feeding pressure fluid into the pressure space 43 in the corrugation cylinder 39 the tubular blank is axially moved toward the head portion 7 through the corrugation distance adjusted by the projections **66*a* and 67**. The various members of the apparatus are now brought to the starting position and the above-described cycle of movements is then repeated.

In the starting position, that is in the rearmost position of the corrugation cylinder 39, the abutment 75 thereon will engage the switch 76 to thereby start the gear motors 59 and 60, which will turn the discs 53 and 54 until the cams thereon in cooperation with the limit switch 79 again stop the motors to thus align a respective projection of each disc respectively with the abutments 64 and 68 to thus change the radial dimension and spacing for the next corrugation.

If, however, it is desired that the radial dimension of the corrugations be changed only after a predetermined number of corrugations, for instance ten, have been formed, then a counter (not shown in the drawing) is used which blocks out the limit switch 76, and which starts the gear motor 59 after ten corrugations of equal dimensions have been formed. The annular disc 54 is then turned until the switching cam 72 engages the limit switch 74 to interrupt the current supply to the gear motor 59 and to stop the latter. The thus-established distance between the axial projections **62*d*, 63*d* and the opposite abutments 64 and 65 forms the upsetting stroke for the next corrugation which determines the radial dimension of the latter. Of course the cutouts 87** in the clamping jaws have to be dimensioned for the largest corrugations to be formed.

The above-described principle applies likewise to the change of the distance of two successive corrugations.

It will be understood that each of the elements described above, or two or more together, may also find a useful application in other types of apparatus for producing a corrugated tube differing from the types described above.

While the invention has been illustrated and described as embodied in an apparatus for producing a tube with successive corrugations of different configuration from a tubular blank of constant diameter, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for producing a tube with successive corrugations of different radial extensions and spacings from a tubular blank of constant diameter, comprising support means; a central pin having an elongated shaft portion fixedly attached only at one end to said support means and having a radially enlarged head portion at the other end; a tubular member mounted on said shaft portion of said central pin for moving in axial direction and adapted to support together with said head portion a tubular blank at the inner surface thereof, said tubular member having one end axially spaced from said head portion to form between said one end and said head portion and a blank supported thereon an annular expansion chamber; first clamping means comprising a plurality of hydraulically operated and radially movable holding and forming jaws opposite said head portion; second clamping means comprising a plurality of circumferentially displaced radially tiltable clamping fingers of a collet arranged in the region of said one end of the tubular member about the outer circumference of a blank supported by the latter; a hydraulically operated axially movable annular clamping piston surrounding said clamping fingers for moving the latter between a clamping and a releasing position; an upsetting cylinder connected at one end to the other end of the tubular member and having opposite said one end a radially enlarged end portion surrounding and guiding said clamping piston for movement in axial direction; an axially movable corrugation cylinder surrounding part of said upsetting cylinder and being formed with an annular groove; a pair of annular discs respectively mounted on opposite ends of said corrugation cylinder turnable about the axis of the latter but axially immovable thereto and each provided with axially extending projections; a pair of abutments respectively provided on said radially enlarged end portion of said upsetting cylinder and on said support means and respectively located opposite said projections; an annular collar fixed to said upsetting cylinder and located in said annular groove of said corrugation cylinder and forming in said groove two chambers adapted to be alternatingly filled with pressure fluid so as to axially move said upsetting cylinder relative to said corrugation cylinder; means for turning said discs to align a respective projection with the corresponding abutment to limit axial movement of said upsetting cylinder; and means for feeding pressure fluid into said expansion chamber after axially spaced portions of the blank have been clamped against the head portion and said one end of the tubular member by said first and said second clamping means to expand a portion of the blank clamped between said first and said second clamping means.

2. An apparatus as defined in claim 1, wherein said axial projections comprise a plurality of abutment cogs of different lengths uniformly spaced in circumferential direction from each other.

3. An apparatus as defined in claim 2, wherein said plurality of abutment cogs are arranged in two groups each extending through 180° in circumferential direction, with the axial length of the cogs in each group changing from one to the next, and with the cog of a given length in one group located diametrically opposite a cog of the same length in the other group.

4. An apparatus as defined in claim 2, wherein said means for turning said annular discs comprise a ring gear fixedly connected to the outer periphery of each disc, a pair of pinions respectively meshing with the ring gears and a pair of gear motors for driving said pinions.

5. An apparatus as defined in claim 4, and including at least two switching cams respectively coordinated with two of said cogs, and a pair of limit switches in circuit with said motors and arranged for being tripped by said cams.

6. An apparatus as defined in claim 5, wherein the positions of said switching cams is adjustable in circumferential direction of said annular disc.

7. An apparatus as defined in claim 5, wherein said switching cams are mounted on ring segments exchangeably connected to that sides of said annular discs which are opposite to the sides thereof from which the cogs project.

8. An apparatus as defined in claim 5, and including an abutment on said corrugation cylinder and a limit switch mounted on said support means and cooperating with said motors in the rest position of said corrugation cylinder.

* * * * *